US008587484B2

(12) United States Patent
Peng et al.

(10) Patent No.: US 8,587,484 B2
(45) Date of Patent: Nov. 19, 2013

(54) QUASI-BALANCED FED ANTENNA STRUCTURE FOR REDUCING SAR AND HAC

(75) Inventors: Chia-Mei Peng, Taoyuan County (TW); I-Fong Chen, Taoyuan County (TW)

(73) Assignee: I-Fong Chen, Taoyuan (TW)

( * ) Notice: Subject to any disclaimer, the term of this patent is extended or adjusted under 35 U.S.C. 154(b) by 174 days.

(21) Appl. No.: 13/235,690

(22) Filed: Sep. 19, 2011

(65) Prior Publication Data

US 2013/0069830 A1 Mar. 21, 2013

(51) Int. Cl.
*H01Q 1/38* (2006.01)
*H01Q 1/24* (2006.01)

(52) U.S. Cl.
USPC ..... 343/700 MS; 343/702

(58) Field of Classification Search
USPC ..... 343/702, 700 MS, 846
See application file for complete search history.

(56) References Cited

U.S. PATENT DOCUMENTS

| | | | | |
|---|---|---|---|---|
| 7,446,717 | B2 * | 11/2008 | Hung et al. | 343/702 |
| 7,602,341 | B2 * | 10/2009 | Wei-Shan et al. | 343/700 MS |
| 8,111,195 | B2 * | 2/2012 | Hung et al. | 343/700 MS |
| 2010/0182210 | A1 * | 7/2010 | Ryou et al. | 343/722 |

* cited by examiner

*Primary Examiner* — Hoanganh Le
(74) *Attorney, Agent, or Firm* — Guice Patents PLLC

(57) ABSTRACT

The proposed antenna structure has first and second asymmetric radiated-strip structures developed by modifying the structure of a printed T-type monopole. Specifically, by combining the radiated-strip and the shorting-line, the proposed antenna structure is similar to modified Type III balun and dipole fed by microstrip-line structure. Hence, the proposed antenna structure can also be regarded as a "quasi-balanced" antenna structure.

5 Claims, 19 Drawing Sheets

| Frequency [MHz] | E-field emission | | H-field emission | |
|---|---|---|---|---|
| | Energy distribution | Category | Energy distribution | Category |
| 850 (CDMA) |  50.12 dB | M3 |  0.24 dB | M3 |
| 902 (GSM) |  47.72 dB | M3 |  -2.21 dB | M3 |
| 1720 (DCS) |  35.64 dB | M3 |  -15.57 dB | M3 |
| 1920 (PCS) |  32.21 dB | M4 |  -14.17 dB | M3 |
| 2045 (WCDMA) |  35.50 dB | M4 |  -13.4 dB | M3 |

QUASI-BALANCED FED ANTENNA STRUCTURE FOR REDUCING SAR AND HAC

BACKGROUND OF THE INVENTION

1. Field of the Invention

A novel hexa-band antenna for mobile handsets application is proposed and analyzed in this specification. An asymmetric T-type monopole antenna with a shorting-line is designed to be operated in code-division multiple access (CDMA, 824-894 MHz), global system for mobile communications (GSM, 880-960 MHz), digital communication system (DCS, 1710-1880 MHz), personal communication system (PCS, 1850-1990 MHz), wideband code division multiple access (WCDMA, 1920-2170 MHz) and Bluetooth (2400-2484 MHz) bands.

A prototype of the proposed antenna with 50 mm in length, mm in height and 15 mm in width is fabricated and experimentally investigated. The experimental results indicate that the VSWR 2:1 bandwidths achieved were 15% and 37.6% at 900 MHz and 2100 MHz, respectively. The specific absorption rate (SAR) and hearing aid compatibility (HAC) for an input power of 24 dBm in CDMA, GSM and WCDMA bands, and an input power of 21 dBm in DCS and PCS bands all meet the SAR limit of 1.6 mW/g. The current distributions on the handset body (ground-plane) as well as on the antenna element are also studied. The capability of the proposed antenna is evidenced by mitigating the degradation of antenna radiated efficiency due to human head effect and reducing SAR and HAC value. Experimental results are shown to verify the validity of theoretical work.

2. Description of the Related Art

Wireless communications continue to enjoy exponential growth in the cellular telephony, wireless Internet, and wireless home networking arenas. In order to roam worldwide, the operation bands of major wireless services, such as code-division multiple access (CDMA), global system for mobile communications (GSM), digital communication system (DCS), personal communication system (PCS), wideband code division multiple access (WCDMA) and Bluetooth should be simultaneously considered (refer to "Ramiro and Chaouki: 'Wireless communications and networking: An overview', *IEEE Antennas Propag. Mag.* (*USA*), vol. 44, pp. 185-193, February, 2002").

Downsizing the handset unit, which has seen remarkable progress in recent years, requires the size reduction of the antenna element also. However, as a small antenna element is used, the utilization of the handset body is beneficial to enhance antenna performance of the handset, because the handset body is usually larger than the antenna element. Therefore, the overall effective antenna dimensions augment dramatically.

As a consequence, the corresponding gain and the bandwidth of the antenna system are increased (refer to "Chih-Hua Chang and Kin-Lu Wong: 'Printed λ/8-PIFA for Penta-Band WWAN Operation in the Mobile Phone', *IEEE Antennas Propag.*, vol. 57, pp. 1373-1381, May, 2009"; "M. Z. Azad and M. Ali: 'A Miniaturized Hilbert PIFA for Dual-band Mobile Wireless Applications', *IEEE Antennas Wireless Propag. Lett.*, vol. 4, pp. 59-62, 2005";" Y. S. Shin, B. N. Kim, W. I. Kwak and S. O. Park: 'GSM/DCS/IMT-2000 triple-band built in antenna for wireless terminals', *IEEE Antenna Wireless Propag. Lett.*, vol. 3, no. 1, pp. 104-107, December, 2004"; "J. D. Kraus and R. J. Marchefka, 'Antennas', Mc Graw-Hill, Third Edition, pp. 804-805, 2002"; "K.-L. Wong, G Y. Lee and T.-W. Chiou: 'A low-profile planar monopole antenna for multiband operation of mobile handsets', *IEEE Antennas Propag.*, vol. 51, no. 1, pp. 121-125, January, 2003"; "Z. Li and Y. Rahmat-Samii: 'Optimization of PIFA-IFA Combination in Handset Antenna Design', *IEEE Antennas Propag.*, vol. 53, pp. 1770-1777, May, 2005"; "P. Vainikainen, J. Ollikainen, O. Kivekäs, and I. Kelander, "Resonator-Based Analysis of the Combination of Mobile Handset Antenna and Chassis," *IEEE Transactions on Antennas and Propagation*, vol. 50, no. 10, pp. 1433-1444, October, 2002"; "A. Cabedo, J. Anguera, C. Picher, M. Ribó, C. Puente, "Multi-Band Handset Antenna Combining a PIFA, Slots, and Ground Plane Modes", *IEEE Transactions on Antennas and Propagation*, vol. 57, no. 9, pp. 2526-2533, September, 2009"; "R. Hossa, A. Byndas, and M. E. Bialkowski, "Improvement of Compact Terminal Antenna Performance by Incorporating Open-End Slots in Ground Plane", *IEEE Microwave and Wireless Components Letters*, vol. 14, no. 6, June, 2004"; "J. Anguera, I. Sanz, A. Sanz, A. Condes, D. Gala, C. Puente, and J. Soler, "Enhancing the performance of handset antennas by means of groundplane design", *IEEE International Workshop on Antenna Technology*: Small Antennas and Novel Metamaterials (iWAT 2006). New York, USA, March, 2006"; and "C. Picher, J. Anguera, A. Cabedo, C. Puente, S. Kahng, "Multiband handset antenna using slots on the ground plane: considerations to facilitate the integration of the feeding transmission line", *Progress In Electromagnetics Research C*, vol. 7, pp. 95-109, 2009").

While the use of the handset body as a part of the radiator is advantageous, it also caused disadvantage at the same time in practical operation. The antenna performance in terms of gain and input impedance varies due to the influence of the human head and hand.

Currently, a handset is normally equipped with PIFA for multi-frequency applications. However, PIFA is an unbalanced antenna having an incomplete radiation pattern. Due to noise interference, a handset of this design cannot reduce SAR (Specific Absorption Rate) and HAC (Hearing Aid Compatibility).

Previous studies (refer to "H. Morishita, H. Furuuchi and K. Fujimoto, "Performance of balanced-Fed antenna system for handsets in the vicinity of a human head or hand," *IEE Proc.—Microw. Antennas Propagat.*, vol. 149, pp. 85-91, 2002"; "J. J. Arenas, J. Anguera, C. Puente, "Balanced and single-ended handset antennas: free space and human loading comparison", *Microwave and Optical Technology Letters*, vol. 51, no. 9, pp. 2248-2254, September, 2009"; "Yongho Kim, Hisashi Morishita, Yoshio Koyanagi and Kyohei Fujimoto: 'A Folded Antenna System for Handset Developed and Based on the Advanced Design Concept', *IEICE Trans. Commun.*, vol. E84-B, pp. 2468-2475, September, 2001") presented an antenna system having a balanced structure is effective in reducing the body effect of the handset antenna systems.

SUMMARY OF THE INVENTION

The present invention has been accomplished under the circumstances in view. In this invention, an asymmetric T-type monopole antenna is designed jointly with the shorting-line to achieve hexa-band (CDMA, GSM, DCS, PCS, WCDMA and Bluetooth) performance. The proposed antenna structure has a first and a second asymmetric radiated-strip structures that is developed by modifying the structure of a printed T-type monopole. Specifically, by combining the radiated-strip and the shorting-line, the proposed antenna structure similar to modified Type III balun and dipole fed by microstrip-line structure. Hence, the proposed antenna structure can also be regarded as a "quasi-balanced" antenna structure.

The feasibility of wide bandwidth operation has been proven by the design of a solid shorted-line and a solid open-stub radiating structure to operate in the dual operating bands. Smaller power loss (dB absorption) due to the influence of phantom-head model is shown.

It is also demonstrated that the proposed quasi-balanced antenna structure produces a low specific absorption rate (SAR) value. In addition, the hearing-aid-compatibility (HAC) standard provides acceptable performance levels for the measurement and evaluation of the mobile handset near-field strength.

BRIEF DESCRIPTION OF THE DRAWINGS

Other and further benefits, advantages and features of the present invention will be fully understood by reference to the following specification in conjunction with the accompanying drawings, in which:

FIG. 1(*a*) is a perspective view of the first asymmetric radiated-strip of the quasi-balanced antenna in accordance with the present invention.

FIG. 1(*b*) is a perspective view of the second asymmetric radiated-strip of the quasi-balanced antenna in accordance with the present invention.

FIG. 4(*b*) is a diagram of Type III balun equivalent circuit in accordance with the present invention.

FIG. 5 (*b*) illustrates the measured V.S.W.R in terms of the first asymmetric radiated-strip and the second asymmetric radiated-strip in accordance with the present invention.

DETAILED DESCRIPTION OF THE PREFERRED EMBODIMENT

Figure 1B:
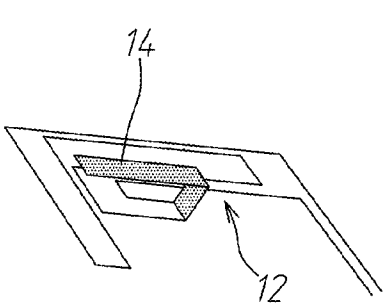
FIG. 1. is a perspective view of a quasi-balanced antenna for hexa-band operation in a mobile handset in accordance with the present invention.
Figure 1A:
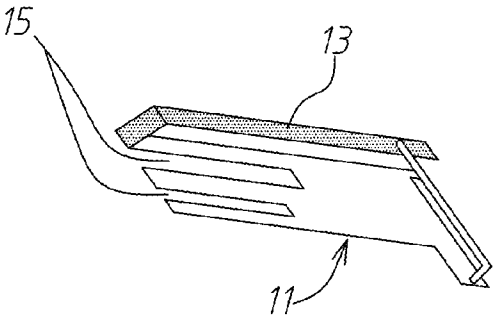
Figure 1:
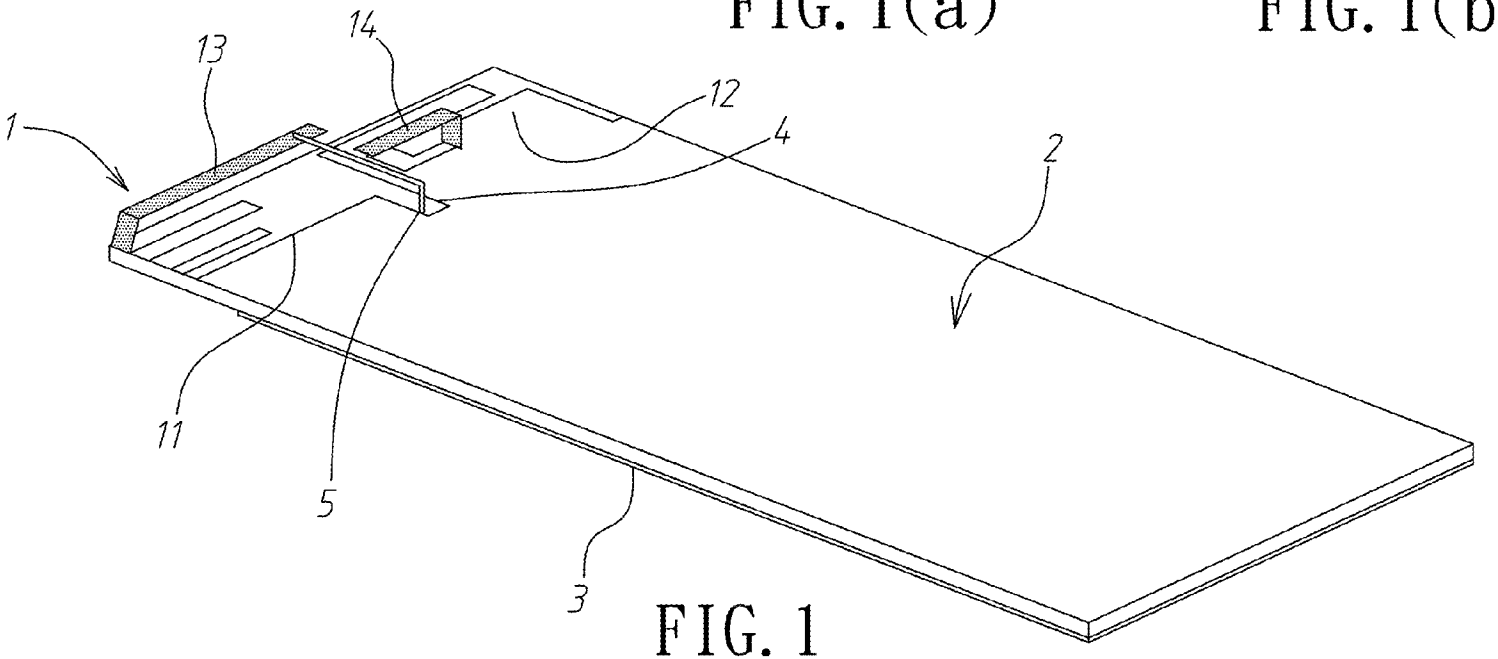

FIG. 1 and FIGS. 1(*a*) & (*b*) show the geometry of the proposed quasi-balanced fed antenna structure for hexa-band operation in the mobile handset.

The presented quasi-balanced fed antenna structure is composed of an asymmetric T-type monopole 1 which is printed on a FR4 glass epoxy substrate 2 with the thickness of 1.6 mm, relative permittivity of 4.3 and loss tangent of 0.023. The proposed asymmetric T-type monopole 1 is placed on a portion without metal ground-plane 3 on the backside. All sections are at the same layer. The asymmetric T-type monopole 1 has a feeding-point 4 and a shorting-point 5 respectively disposed in the rear end of the asymmetric T-type monopole 1. Further, the shorting-point 5 is electrically connected to the solid shorting-line 13.

The asymmetric T-type monopole 1 includes a first asymmetric radiated-strip 11 and a second asymmetric radiated-strip 12. The first asymmetric radiated-strip 11 combined with a solid shorting-line 13 to form a balanced antenna, like a loop structure. The second asymmetric radiated-strip 12 combined with a solid open-stub 14 to form an un-balanced antenna.

The electrical-length of the radiating elements can be determined from the quarter-wave length at the resonant frequencies. Detailed dimensions of the proposed quasi-balanced antenna are given in FIGS. 2 and 3.

In the first asymmetric radiated-strip 11, the resonant frequency is designed to occur at 1800 MHz, the electrical-length of the planar-strip is equal to 40 mm (which is 15 mm+25 mm). For covering DSC, PCS, WCDMA and Bluetooth bands, the shape of first asymmetric radiated-strip 11 is designed for wideband operation, the tuning of broad bandwidth is obtained by increasing strip-area and making some slits 15 thereon. These slits 15 cause the discontinuities of the current distribution on the surface of radiating-strip which improves the impedance bandwidth (refer to: C.-M. Peng, I.-F. Chen and C.-W. Hsue: 'Modified printed folded λ/8 dipole antenna for DVB applications', *IEICE Trans. Commun.*, vol. E90-B, pp. 2991-2994, October, 2007; I-Fong Chen, Chia-Mei Peng and Sheng-Chieh Liang, "Single layer printed monopole antenna for dual ISM-band operation", *IEEE Trans. Antennas Propagat.*, Vol. 53, No. 4, pp. 1270-1273, April. 2005.).

In the second asymmetric radiated-strip 12, the resonant frequency is designed to occur at 900 MHz, the electrical-length of the planar-strip is equal to 80 mm (which is 15 mm+25 mm+6 mm+22 mm+5 mm+7 mm). For covering CDMA and GSM bands, the solid-open stub 14 is used as a top-loading of the second asymmetric radiated-strip 12 and it increases the electrical-length and impedance bandwidth in the antenna's lower-operating band.

The impedance matching at lower- and upper-operating bands can be also tuned by the solid shorting-line 13 of the first asymmetric radiated-strip 11 and the extended strip of the second asymmetric radiated-strip 12. The solid shorting-line 13 is found to be effective in obtaining a wider impedance bandwidth in the antenna's upper-operating band.

Note that the widths of these strips, slits 15, solid shorting-line 13 and solid open-stub 14, etc, are not identical. By selecting appropriate dimensions (first asymmetric radiated-strip 11, second asymmetric radiated-strip 12) of the antenna structure, good impedance matching of the asymmetric T-type monopole 1 can be obtained, and thus the bandwidth is also extended.

Figure 4A:
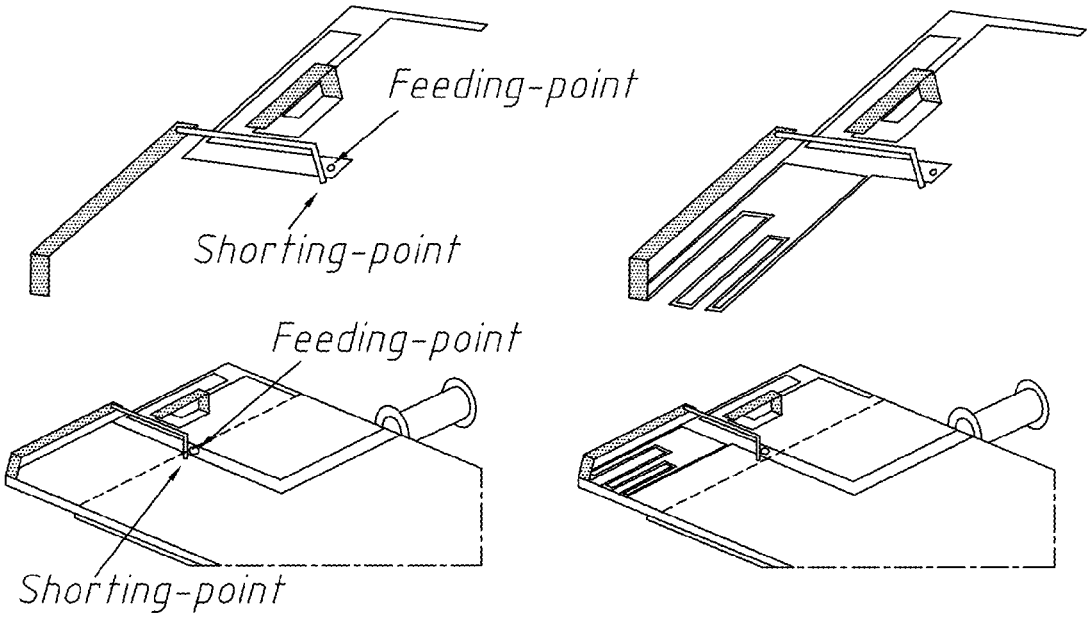
FIG. 4(*a*) is a perspective view of Type III balun and dipole fed by microstrip.
Figure 4B:
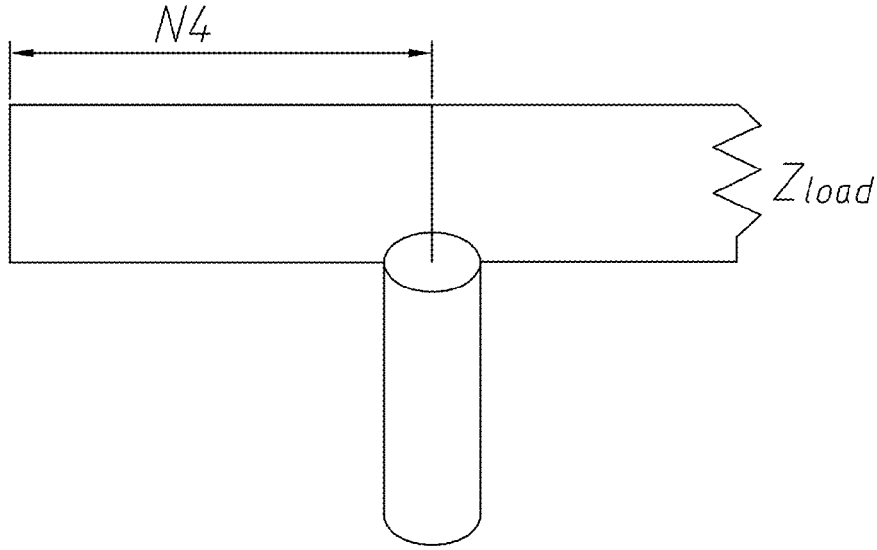

Furthermore, the first asymmetric radiated-strip 11 is a loop structure, the electrical length of the loop trace is designed nearly the quarter-wave length of 1800 MHz, which lets the proposed quasi-balanced antenna structure be similar to the modified Type III balun and dipole fed by microstrip-line [5], as shown in FIGS. 4(*a*) and (*b*). As a consequence, a "quasi-balanced" antenna structure is formed. It has been indicated in references: H. Morishita, H. Furuuchi and K. Fujimoto, "Performance of balanced-Fed antenna system for handsets in the vicinity of a human head or hand," *IEE Proc.—Microw. Antennas Propagat.*, vol. 149, pp. 85-91, 2002; J. J. Arenas, J. Anguera, C. Puente, "Balanced and single-ended handset antennas: free space and human loading comparison", *Microwave and Optical Technology Letters*, vol. 51, no. 9, pp. 2248-2254, September, 2009; Yongho Kim, Hisashi Morishita, Yoshio Koyanagi and Kyohei Fujimoto: 'A Folded Antenna System for Handset Developed and Based on the Advanced Design Concept', *IEICE Trans. Commun.*, vol. E84-B, pp. 2468-2475, September, 2001, that a balanced antenna system can mitigate the performance degradation of an antenna due to the influence of the human head.

Besides, "A. Cabedo, J. Anguera, C. Picher, M. Ribó, C. Puente, "Multi-Band Handset Antenna Combining a PIFA, Slots, and Ground Plane Modes", *IEEE Transactions on Antennas and Propagation*, vol. 57, no. 9, pp. 2526-2533, September, 2009" also indicated that the ground-plane mode is responsible for SAR. Hence, in order to demonstrate the low current distribution on the handset body, the effect of varying the ground-plane 3 length of a quasi-balanced and un-balanced antenna structures is investigated by simulations. Detail results will be presented and discussed in the next section.

EXPERIMENTAL RESULTS AND DISCUSSION

Figure 5A:
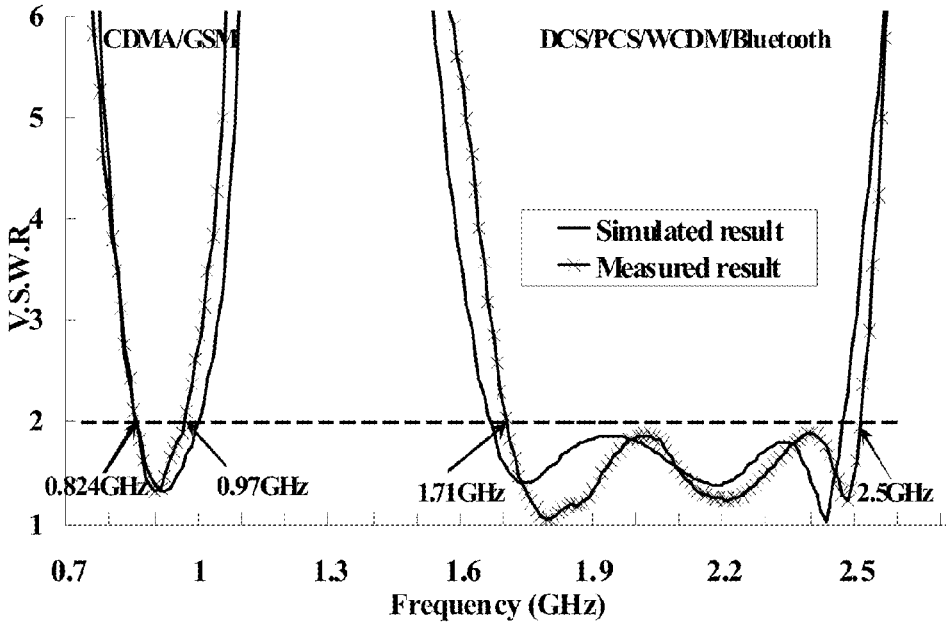
FIG. 5(*a*) illustrates the measured and simulated V.S.W.R against frequency.
Figure 5B:
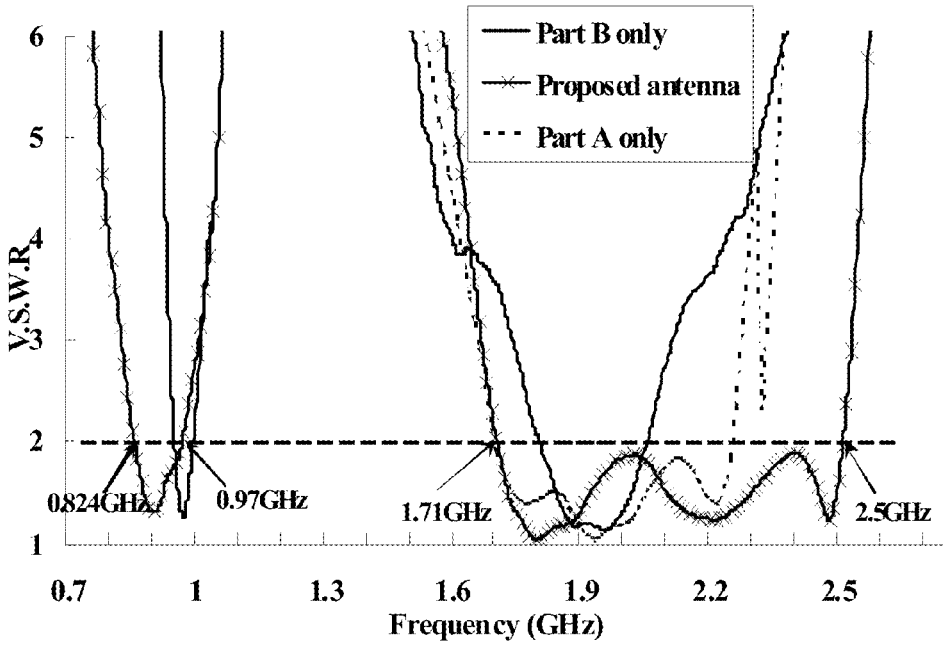

In the experiment, the microstrip feed-line and ground-plane are connected to a 50Ω SMA connector. By using the described design procedure, a hexa-band antenna is constructed to operate in the range of a dual operating-band: lower-operating band (CDMA and GSM) and upper-operating band (DCS, PCS, WCDMA and Bluetooth). FIG. 5(*a*) shows the measured and simulated V.S.W.R plot of the dual band antenna and the V.S.W.R≤2 bandwidths are 135 MHz (15%) and 790 MHz (37.6%) at 900 MHz and 2100 MHz, respectively. The simulated results are obtained by using the Ansoft HFSS. We can also find that a good agreement between the simulation and measurement is obtained. FIG. 5(*b*) shows the measured V.S.W.R of the proposed quasi-balanced antenna in terms of the first asymmetric radiated-strip 11 and the second asymmetric radiated-strip 12.

Figure 6A:
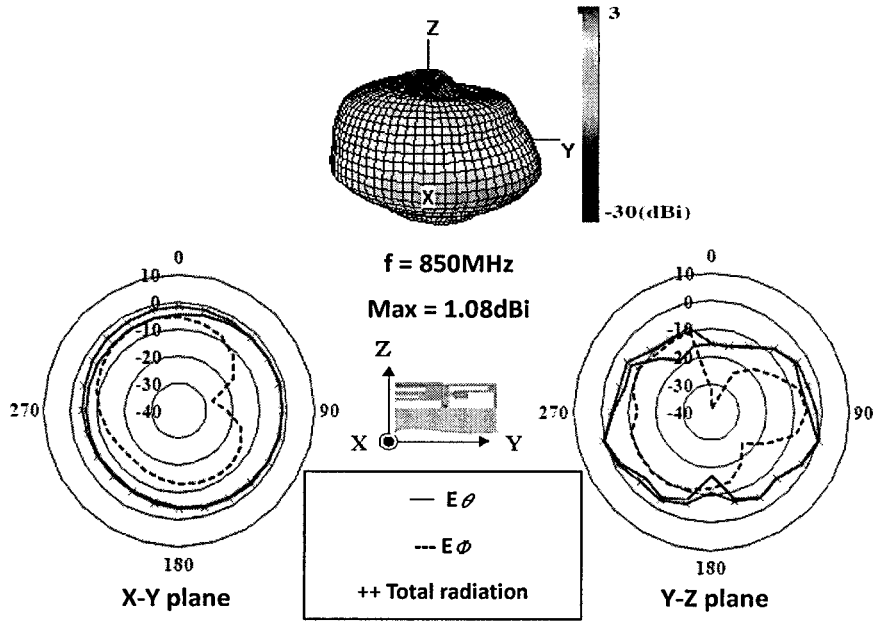
FIGS. 6(*a*) and (*b*) illustrate the measured 3-D and 2-D radiation patterns at (*a*) 850 MHz and (*b*) 902 MHz for the quasi-balanced antenna in accordance with the present invention.
Figure 6B:
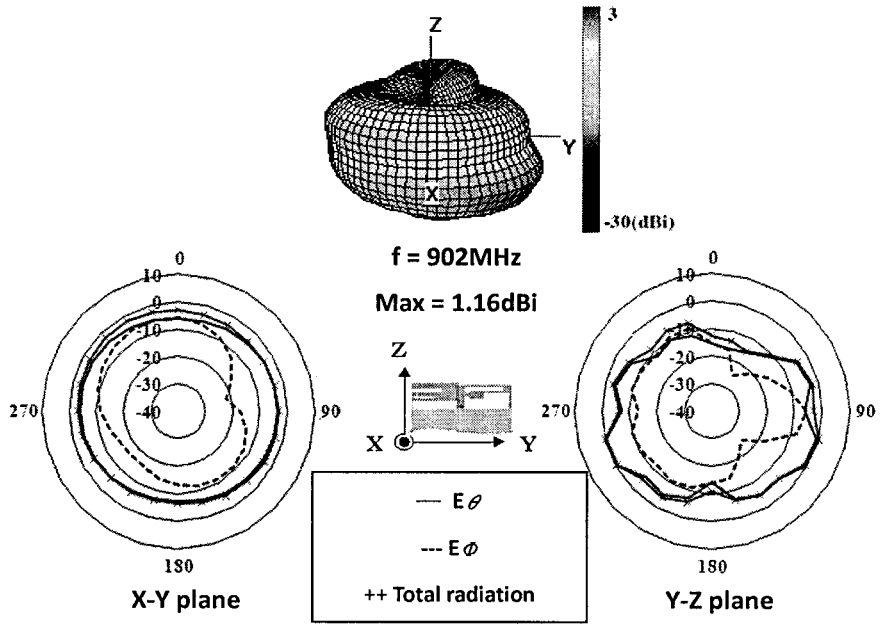
Figure 7A:
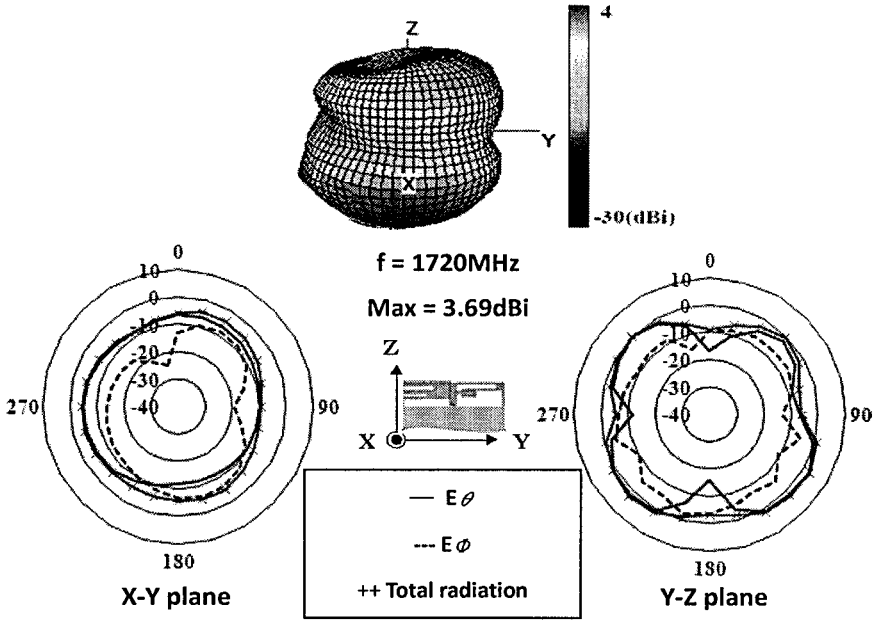
FIGS. 7(*a*)~(*d*) illustrate the measured 3-D and 2-D radiation patterns at (*a*)1720 MHz (*b*) 1920 MHz (*c*) 2045 MHz (*d*) 2450 MHz for the quasi-balanced antenna in accordance with the present invention.
Figure 7B:
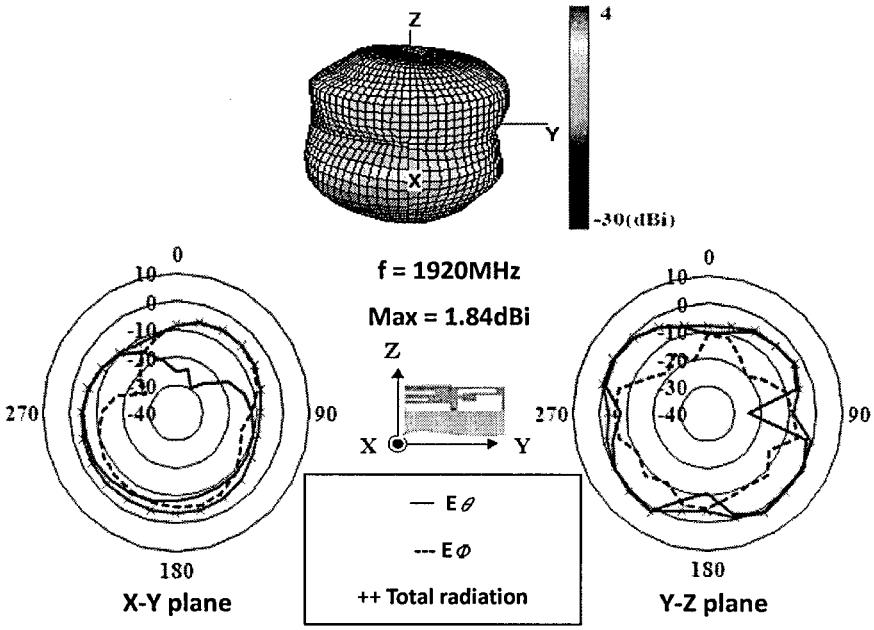
Figure 7C:
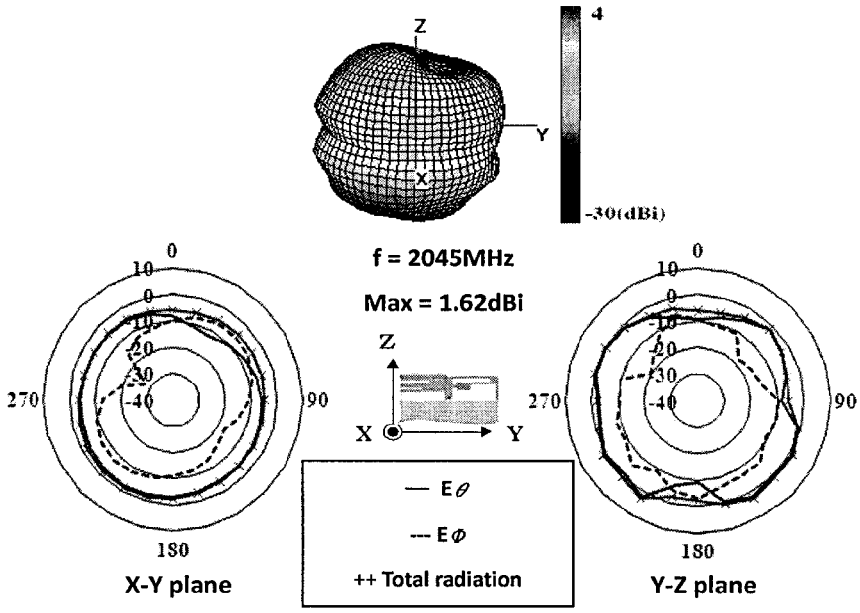
Figure 7D:
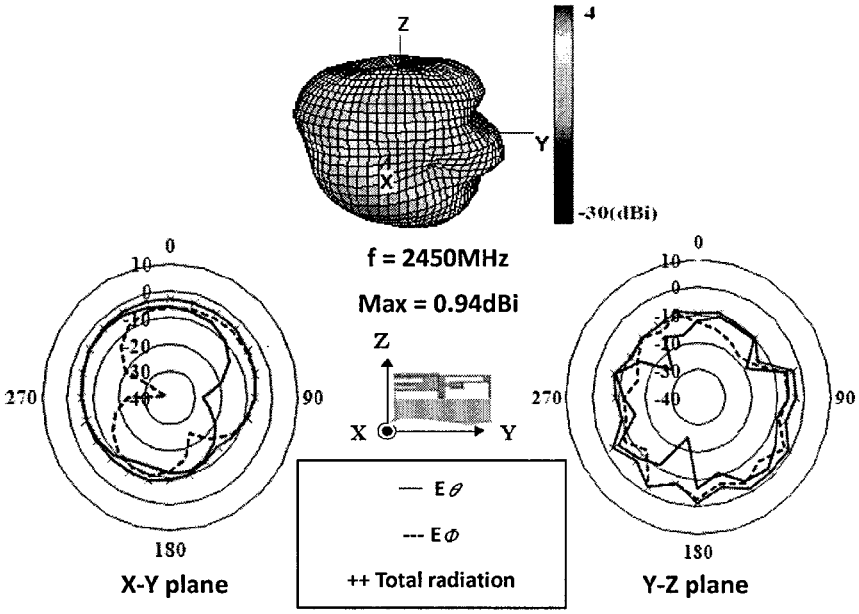
Figure 8A:
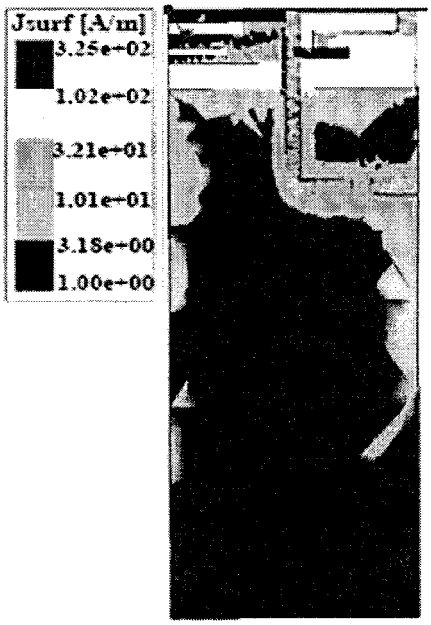
FIGS. 8(*a*)~(*f*) illustrates the simulated current distribution of the quasi-balanced antenna structure on the handset body (the ground-length is 100 mm) at (*a*) 850 MHz (*b*) 902 MHz (*c*) 1720 MHz (*d*) 1920 MHz (*e*) 2045 MHz (*f*) 2450 MHz respectively.
Figure 8B:
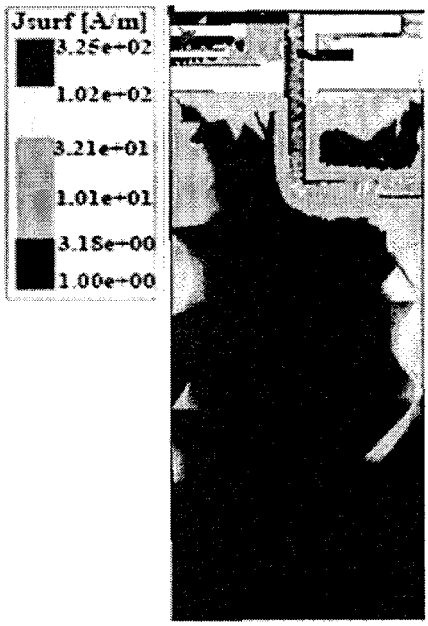
Figure 8C:
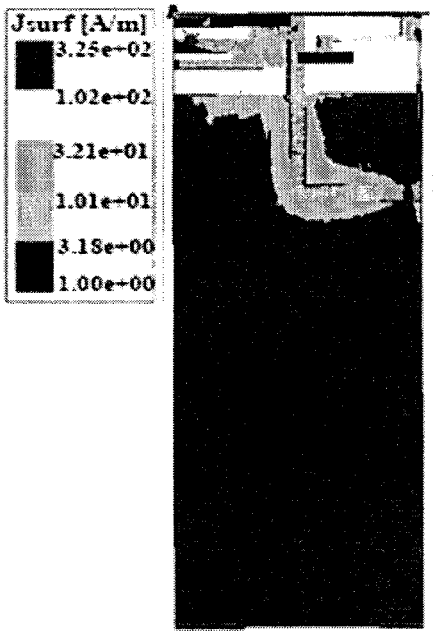
Figure 8D:
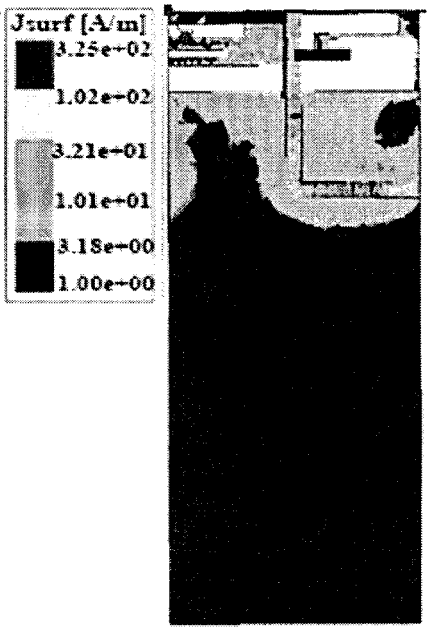
Figure 8E:
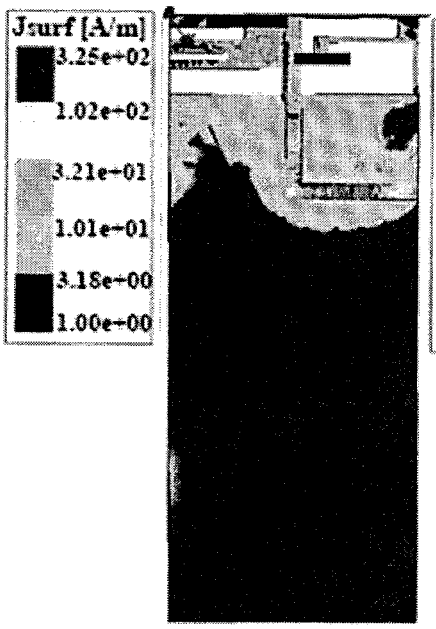
Figure 8F:
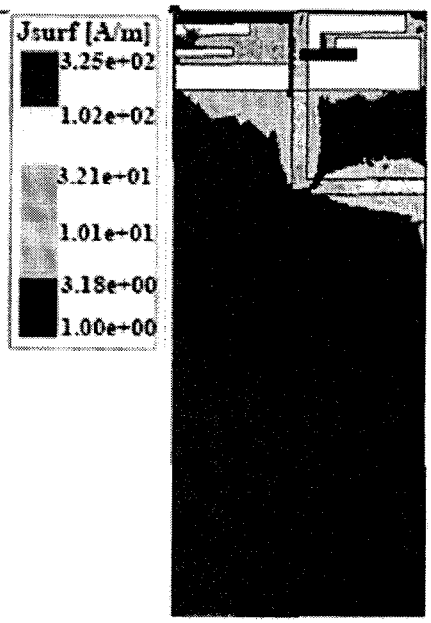

For the first asymmetric radiated-strip 11 only, the radiated-strip and the shorting-line are matched at the DCS, PCS and WCDMA bands. The 560 MHz (28% at 2000 MHz) operating bandwidth is larger than the circular loop antenna (~8%). This is due to the fact that the surface current distribution of the asymmetric radiated-strip is discontinuous. For the second asymmetric radiated-strip 12 only, the modified bended monopole antenna is matched at the GSM and PCS bands. As expected, the measured results indicate that the first asymmetric radiated-strip 11 and second asymmetric radiated-strip 12 introduce an upper- and lower-operating band, respectively. FIGS. 6 (*a*) and (*b*) present the measured 3-D and 2-D radiation patterns in the free space at 850 MHz and 902 MHz in the xy-plane (Horizontal-plane) and yz-plane (Vertical-plane), respectively. It is obvious that the dipole-like radiation patterns are observed. In other words, at the lower-operating bands, the ground-plane becomes a part of the antenna, and is responsible for the radiation (refer to: "A. Cabedo, J. Anguera, C. Picher, M. Ribó, C. Puente, "Multi-Band Handset Antenna Combining a PIFA, Slots, and Ground Plane Modes", *IEEE Transactions on Antennas and Propagation*, vol. 57, no. 9, pp. 2526-2533, September, 2009").

The measured radiation patterns at 1720, 1920, 2045 and 2450 MHz are shown in FIGS. 7 (*a*)~(*d*). From FIGS. 7 (*a*)~(*d*), more variations in the radiation pattern-shapes are obtained, as compared to those in FIGS. 6(*a*) and (*b*). This is mainly owing to the current distribution on the handset body is lower than that on the antenna itself at the upper-operating bands (refer to: "A. Cabedo, J. Anguera, C. Picher, M. Ribó, C. Puente, "Multi-Band Handset Antenna Combining a PIFA, Slots, and Ground Plane Modes", *IEEE Transactions on Antennas and Propagation*, vol. 57, no. 9, pp. 2526-2533, September, 2009"). Table I presents the measured antenna gain and the total efficiency of the proposed quasi-balanced antenna in the free space (without human-head) and with human-head.

TABLE I

The measured antenna gains and the total efficiency within the operating bandwidth of the proposed quasi-balanced antenna.

| Frequency (MHz) | Efficiency (%) (Antenna in free space) | Efficiency (%) (Antenna with phantom head) | Loss (dB) (Antenna with phantom head) | Efficiency (%) (Antenna with phantom hand) | Loss (dB) (Antenna with phantom hand |
|---|---|---|---|---|---|
| 850 | 60.23 | 23.61 | 4.07 | 33.15 | 2.59 |
| 902 | 61.47 | 25.51 | 3.82 | 33.41 | 2.65 |
| 1720 | 64.21 | 27.43 | 3.69 | 30.39 | 3.25 |

TABLE I-continued

The measured antenna gains and the total efficiency within the operating bandwidth of the proposed quasi-balanced antenna.

| Frequency (MHz) | Efficiency (%) (Antenna in free space) | Efficiency (%) (Antenna with phantom head) | Loss (dB) (Antenna with phantom head) | Efficiency (%) (Antenna with phantom hand) | Loss (dB) (Antenna with phantom hand |
|---|---|---|---|---|---|
| 1920 | 68.11 | 27.91 | 3.87 | 31.74 | 3.32 |
| 2045 | 71.44 | 26.53 | 4.30 | 38.02 | 2.74 |
| 2450 | 68.73 | 25.67 | 4.28 | 35.83 | 2.83 |

Acceptable radiation characteristic for the practical applications is obtained for the proposed quasi-balanced antenna. The gain variation in the broadside direction is less than 3 dB as compared to that in the maximum radiation level. Stable radiation patterns are observed in the figure. The omni-directional feature of the proposed quasi-balanced antenna can be observed from the Horizontal-plane, where the gain variation between the maximum and the minimum levels is less than 5 dB. The effect of the proposed quasi-balanced antenna structure on the antenna performance is also studied and the results are described below.

In addition, the SAR and HAC results of the proposed quasi-balanced antenna are also analyzed.

Analysis of the Proposed Quasi-Balanced Antenna Structure

Figure 2:
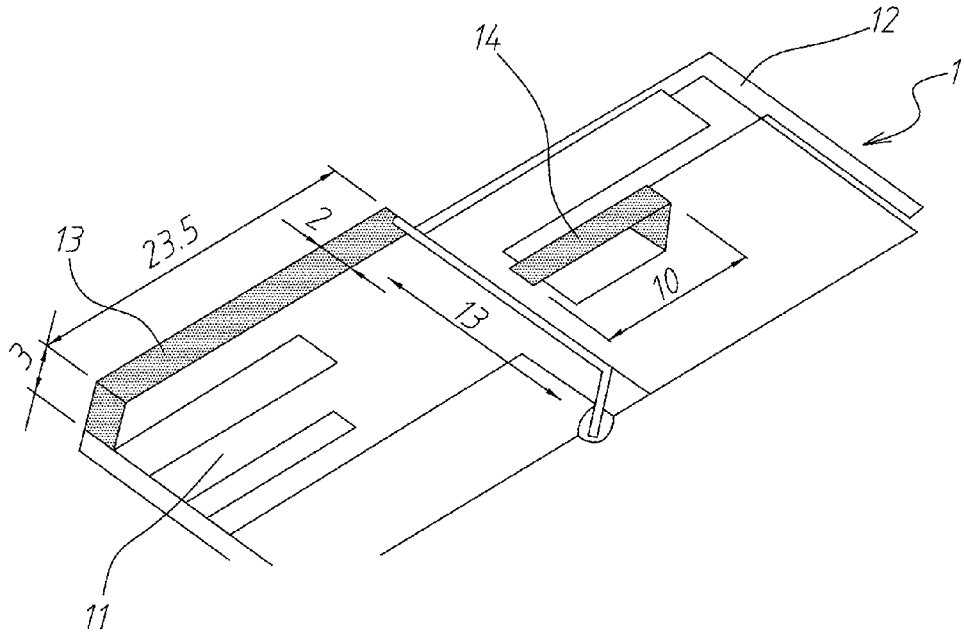
FIGS. 2 and 3 explain the dimensions of the proposed quasi-balanced antenna in accordance with the present invention.
Figure 3:
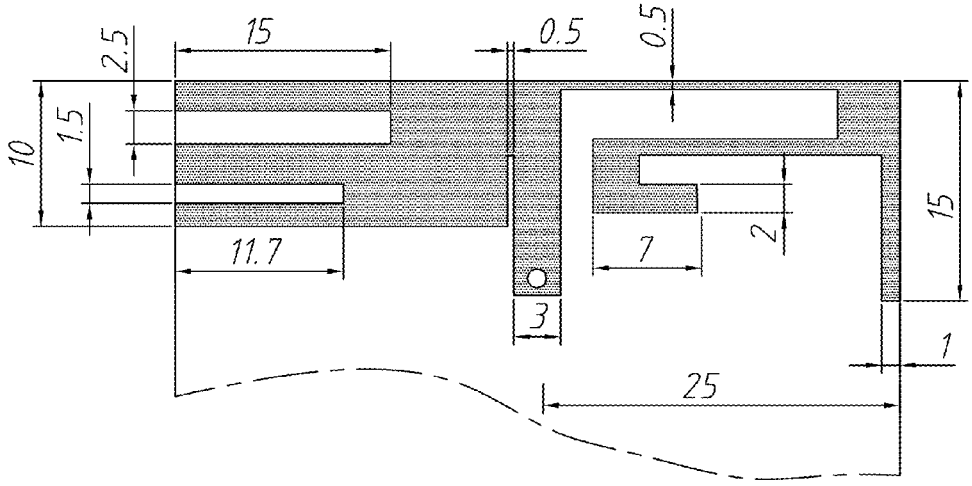

The quasi-balanced structure of the proposed antenna is shown in FIG. 2. The design parameters and the corresponding characteristics of the resonant frequency, input impedance and bandwidth are a function of the geometrical parameters of the proposed quasi-balanced structure. The simulated current distribution of the proposed quasi-balanced antenna structure on the handset body is shown in FIGS. 8(*a*)~(*f*).

In the upper-operating band, only a few current is distributed on the handset body. Note that a small loop antenna can be regarded as a magnetic dipole normal to the loop plane and it reduces the current flow on the handset body (refer to "P. Vainikainen, J. Ollikainen, O. Kivekäs, and I. Kelander, "Resonator-Based Analysis of the Combination of Mobile Handset Antenna and Chassis," *IEEE Transactions on Antennas and Propagation*, vol. 50, no. 10, pp. 1433-1444, October, 2002" and "A. Cabedo, J. Anguera, C. Picher, M. Ribó, C. Puente, "Multi-Band Handset Antenna Combining a PIFA, Slots, and Ground Plane Modes", *IEEE Transactions on Antennas and Propagation*, vol. 57, no. 9, pp. 2526-2533, September, 2009").

However, in the lower-operating band, more current are distributed on the handset body as compared to those in the upper-operating band. That is because in the lower-operating band, the electrical-length of the modified bended monopole is over one quarter-wavelength, as a consequently, the input impedance of the modified bended monopole is matched to the handset body (refer to "J. D. Kraus and R. J. Marchefka, 'Antennas', Mc Graw-Hill, Third Edition, pp. 804-805, 2002";" K.-L. Wong, G Y. Lee and T.-W. Chiou: 'A low-profile planar monopole antenna for multiband operation of mobile handsets', *IEEE Antennas Propag.*, vol. 51, no. 1, pp. 121-125, January, 2003";" Z. Li and Y Rahmat-Samii: 'Optimization of PIFA-IFA Combination in Handset Antenna Design', *IEEE Antennas Propag., vol.* 53, pp. 1770-1777, May, 2005";" P. Vainikainen, J. Ollikainen, O. Kivekäs, and I. Kelander, "Resonator-Based Analysis of the Combination of Mobile Handset Antenna and Chassis," *IEEE Transactions on Antennas and Propagation*, vol. 50, no. 10, pp. 1433-1444, October, 2002"; and "A. Cabedo, J. Anguera, C. Picher, M. Ribó, C. Puente, "Multi-Band Handset Antenna Combining a PIFA, Slots, and Ground Plane Modes", *IEEE Transactions on Antennas and Propagation*, vol. 57, no. 9, pp. 2526-2533, September, 2009"). So, there is more power loss at the lower-operating band than that at the upper-operating band, as shown in Table I. The effect of varying the length of ground-plane on the antenna's bandwidth and the surface current density are presented to verify that the proposed quasi-balanced antenna is with the features of the balanced structure.

Figure 9:
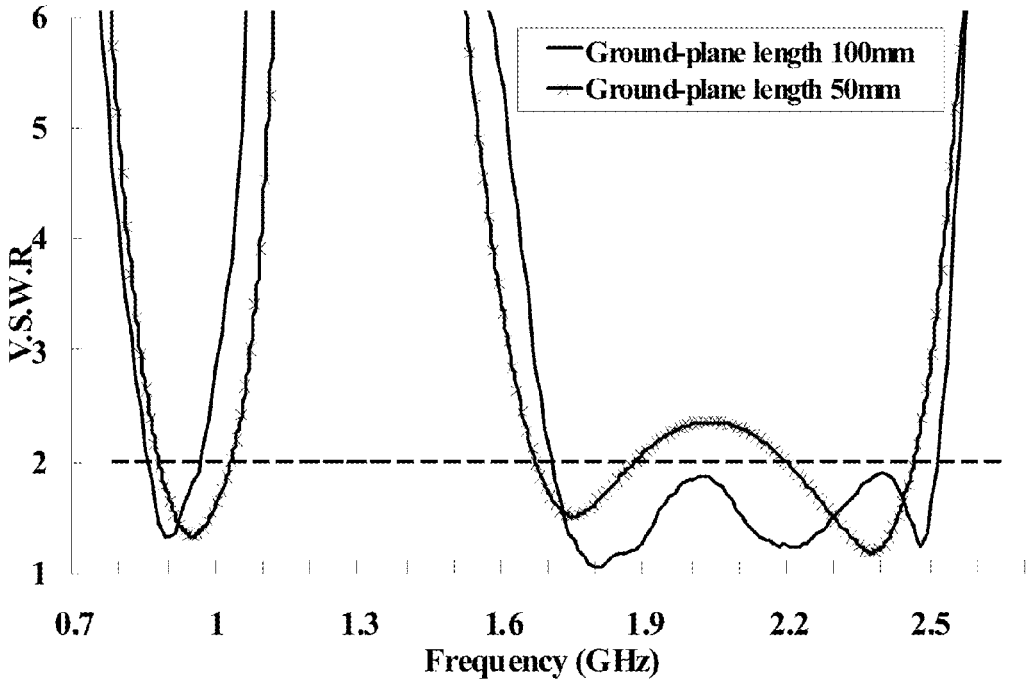
FIG. 9 illustrates the measured V.S.W.R against frequency of varying ground-plane length.
Figure 10A:
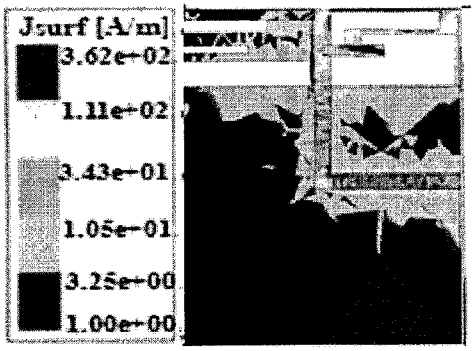
FIGS. 10(*a*)~(*f*) illustrates the simulated current distribution of the quasi-balanced antenna structure on the ground-plane (the ground-length is 50 mm) at (*a*) 850 MHz (*b*) 902 MHz (*c*) 1720 MHz (*d*) 1920 MHz (*e*) 2045 MHz (*f*) 2450 MHz respectively.
Figure 10B:
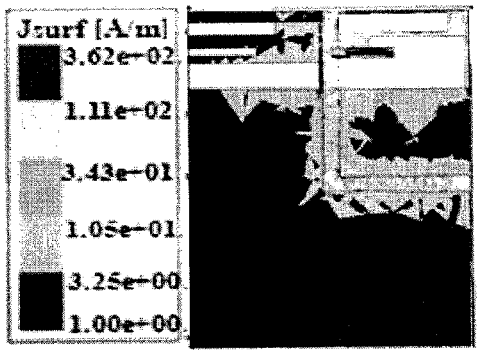
Figure 10C:
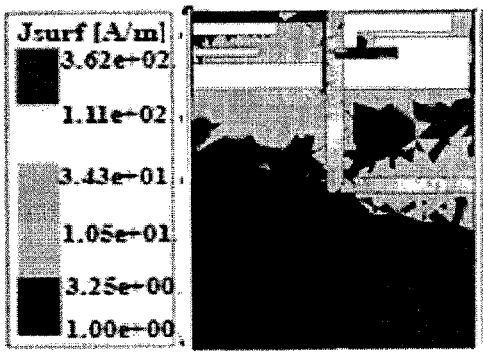
Figure 10D:
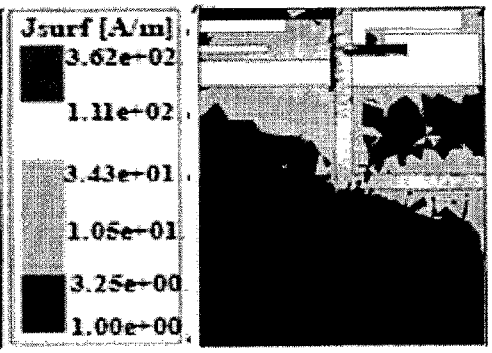
Figure 10E:
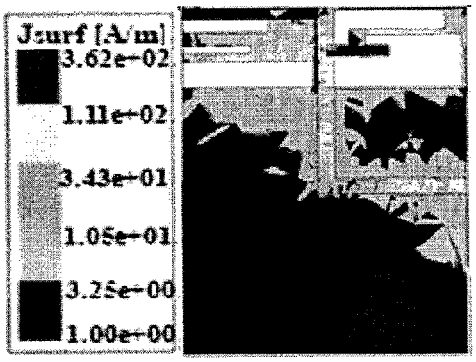
Figure 10F:
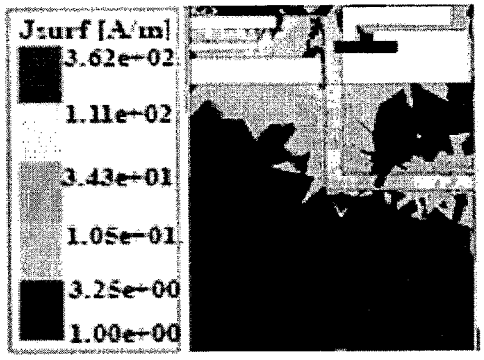

First, the measured V.S.W.R of the proposed quasi-balanced antenna for various ground-plane lengths from 50 mm to 100 mm is analyzed. It is observed that the operating bandwidths remain the same, as shown in FIG. 9.

Next, the simulated current distributions on the ground-plane (the length is 50 mm) are shown in FIGS. 10(*a*)~(*f*). Comparing FIGS. 8(*a*)~(*f*) and FIGS. 10(*a*)~(*f*), we can find that only slightly differences in the surface current density for the proposed quasi-balanced antenna structure on the handset body. Thus, we conclude that the proposed quasi-balanced antenna is indeed with the features of the balanced structure over the hexa-operating bands.

Figure 11:
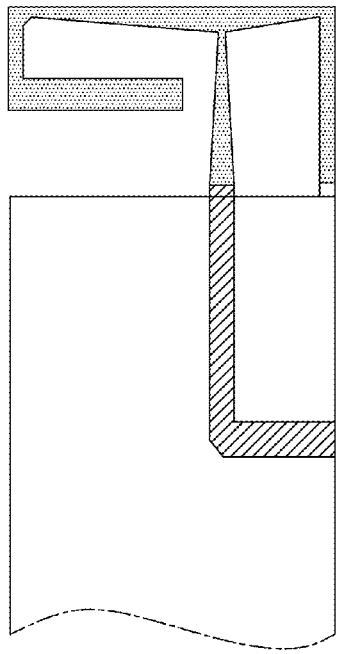
FIG. 11 (PRIOR ART)
FIG. 11 illustrates the dimensions of a planar inverted F antenna (PIFA) according to the prior art.

Next, we provide a proper comparison between a quasi-balanced and un-balanced antenna structures. Here, a conventional planar inverted F antenna (PIFA) is denoted as an un-balanced structure, which is put on the same PCB substrate as shown in FIG. 1, and the dimensions of the PIFA are shown in FIG. 11. The measured V.S.W.R plot for different ground-plane lengths of PIFA is shown in FIG. 12.

Figure 12:
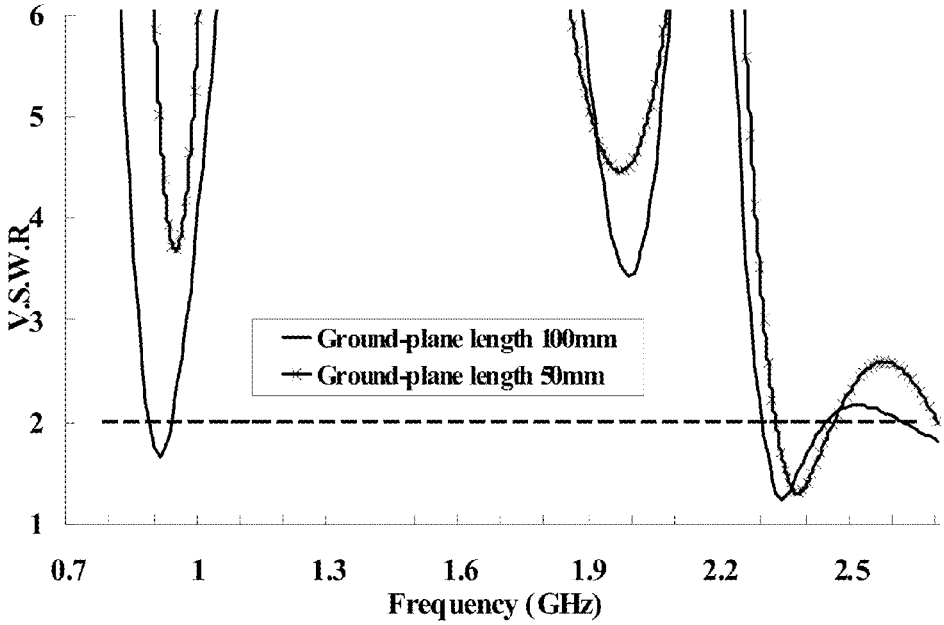
FIG. 12 (PRIOR ART)
FIG. 12 illustrates the measured V.S.W.R against frequency of varying ground-plane length.
Figure 13A:
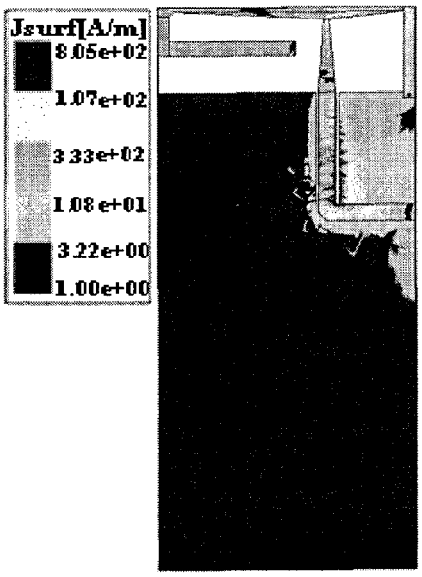
FIG. 13(a) (PRIOR ART)
FIGS. 13(*a*)~(*d*) illustrates the simulated current distribution of the prior art antenna on the ground-plane at (*a*) 902 MHz (the ground-length is 100 mm) (*b*) 902 MHz (the ground-length is 50 mm) (*c*) 2450 MHz (the ground-length is 100 mm) (*d*) 2450 MHz (the ground-length is 50 mm) respectively.
Figure 13B:
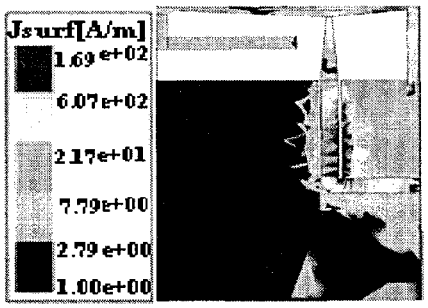
FIG. 13(b) (PRIOR ART)
Figure 13C:
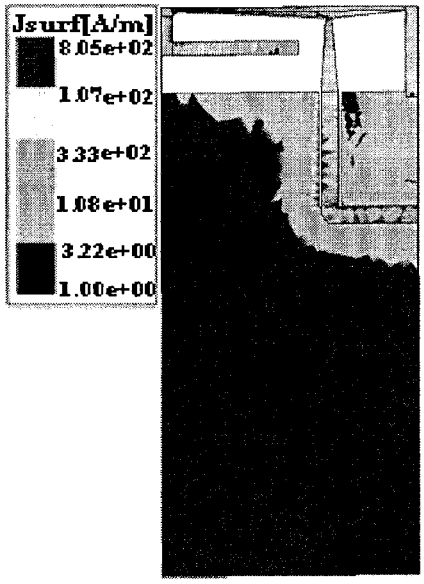
FIG. 13(c) (PRIOR ART)
Figure 13D:
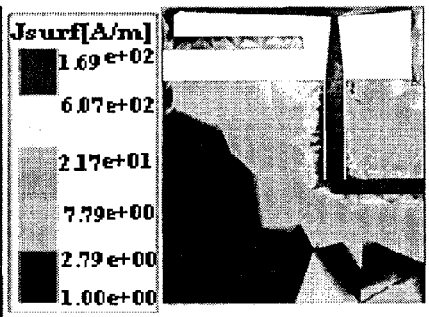
FIG. 13(d) (PRIOR ART)

By analyzing the measured V.S.W.R obtained in FIG. 12, we observed that large variation is occurred at the low frequency. FIGS. 13(*a*)~(*d*) show the simulated current distribution of the un-balanced antenna at 902 MHz and 2450 MHz. It clearly shows that the surface current density is also low on the ground-plane of the un-balanced antenna. However, the effect of various ground-plane lengths on the current distributions is very large.

When a mobile handset is used in close proximity to a human head, dielectric-loading effect can be expected, there may also be a detuning issue.

Figure 14:
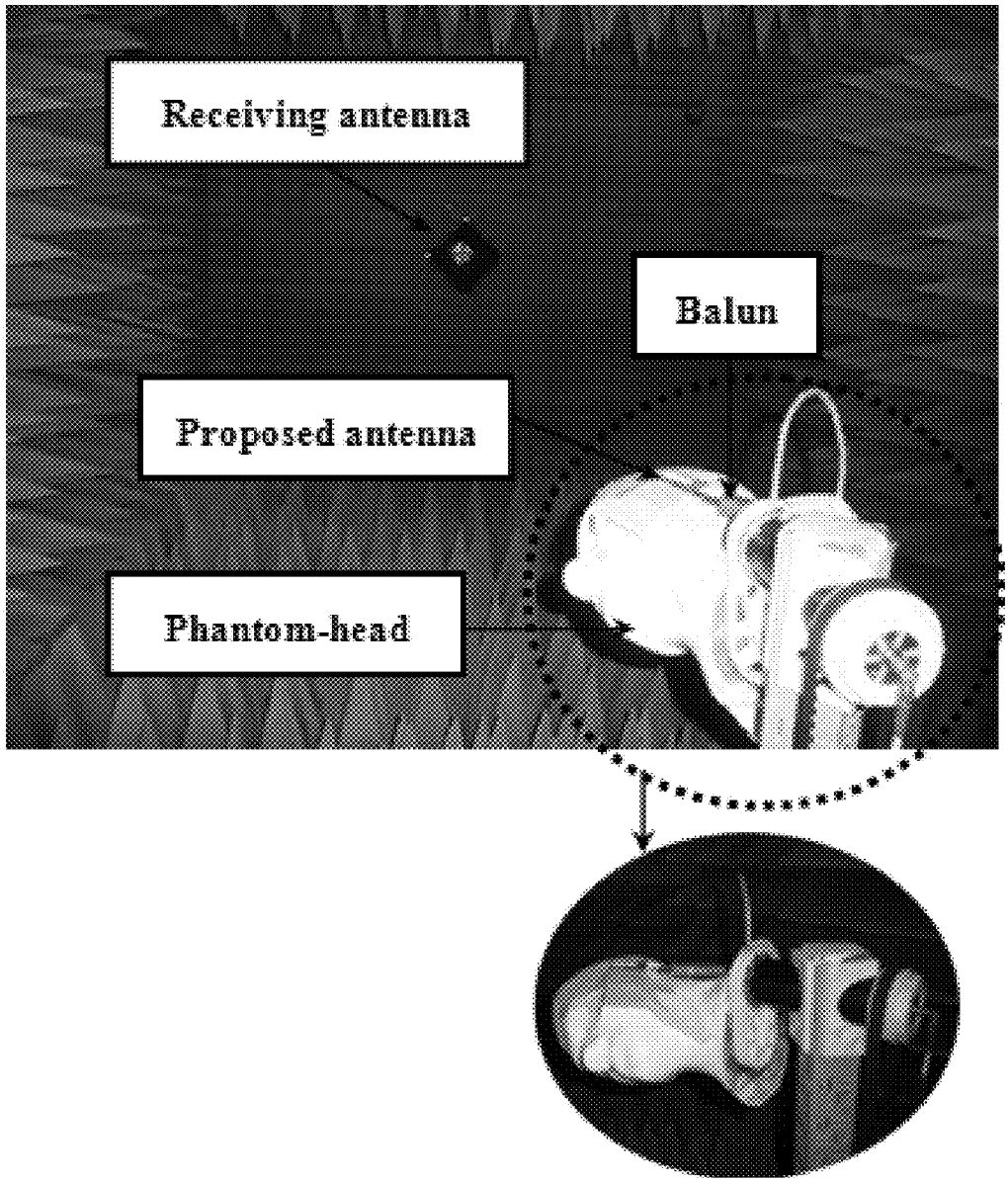
FIG. 14 is a photo of the experimental arrangement for efficiency measurement with phantom-head.

In order to demonstrate the distinctive performance of the proposed quasi-balanced antenna in the presence of a human head, the measurement efficiency set-up with the phantom-head is shown in FIG. 14.

The liquid parameters used in the measurements are listed in Table II.

TABLE II

The liquid property of phantom-head.

| Target frequency (MHz) | $\epsilon r$ | $\sigma$(S/m) |
|---|---|---|
| 835 | 30.3 | 0.59 |
| 900 | 30 | 0.62 |
| 1800 | 27 | 0.99 |

TABLE II-continued

The liquid property of phantom-head.

| Target frequency (MHz) | εr | σ(S/m) |
|---|---|---|
| 1900 | 26.7 | 1.04 |
| 1950 | 26.6 | 1.07 |
| 2000 | 26.5 | 1.09 |
| 2100 | 26.3 | 1.14 |
| 2450 | 25.7 | 1.32 |

εr = relative permittivity and σ = conductivity

Figure 15:
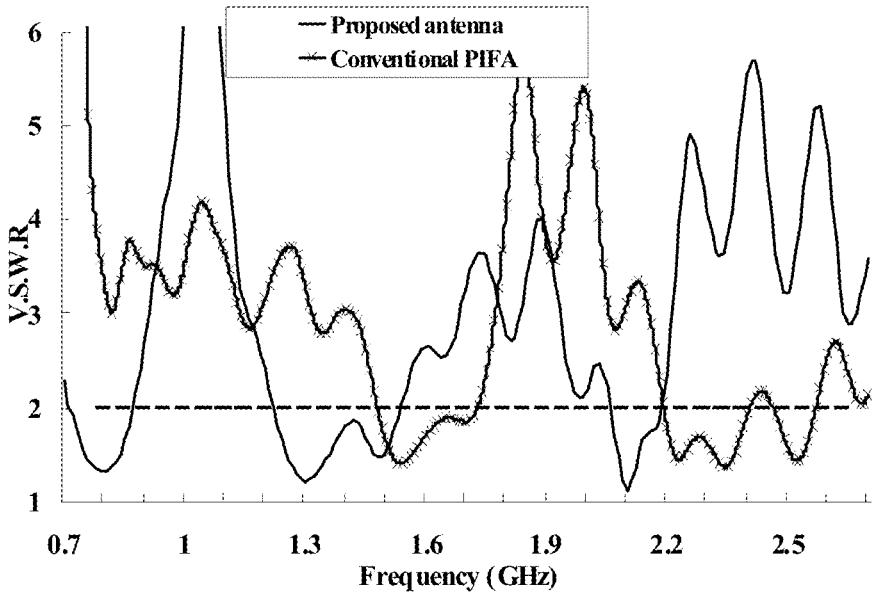
FIG. 15 illustrates the measured V.S.W.R against frequency of antenna with phantom-head.

The measured V.S.W.R against frequency of antenna with phantom-head is shown in FIG. 15. The degradation of total efficiency of antenna with phantom-head is shown in Table III.

TABLE III

The comparison results of the antenna with phantom-head. (The length of ground-plane is 100 mm)

| Frequency (MHz) | Proposed Antenna Efficiency (%) | Proposed Antenna with Head Efficiency (%) | Head Loss of proposed antenna (dB) | PIFA Efficiency (%) | PIFA with Head Efficiency (%) | Head Loss of PIFA (dB) |
|---|---|---|---|---|---|---|
| 850 | 52.23 | 13.12 | 5.99 | 53.55 | 8.28 | 8.10 |
| 880 | 59.71 | 18.40 | 5.11 | 59.16 | 8.78 | 8.28 |
| 902 | 60.05 | 15.44 | 5.89 | 66.13 | 8.56 | 8.88 |
| 960 | 52.79 | 12.23 | 6.35 | 60.77 | 7.57 | 8.02 |
| 1990 | 68.24 | 25.58 | 4.26 | 70.02 | 10.52 | 8.23 |
| 2450 | 50.34 | 17.28 | 4.64 | 70.17 | 9.01 | 8.91 |

It clearly shows that the conventional PIFA is with more power loss than the proposed quasi-balanced antenna. This proves the radiation comes from the antenna rather than the ground-plane on the proposed quasi-balanced antenna structure.

Analysis of the SAR and HAC

Figure 16:
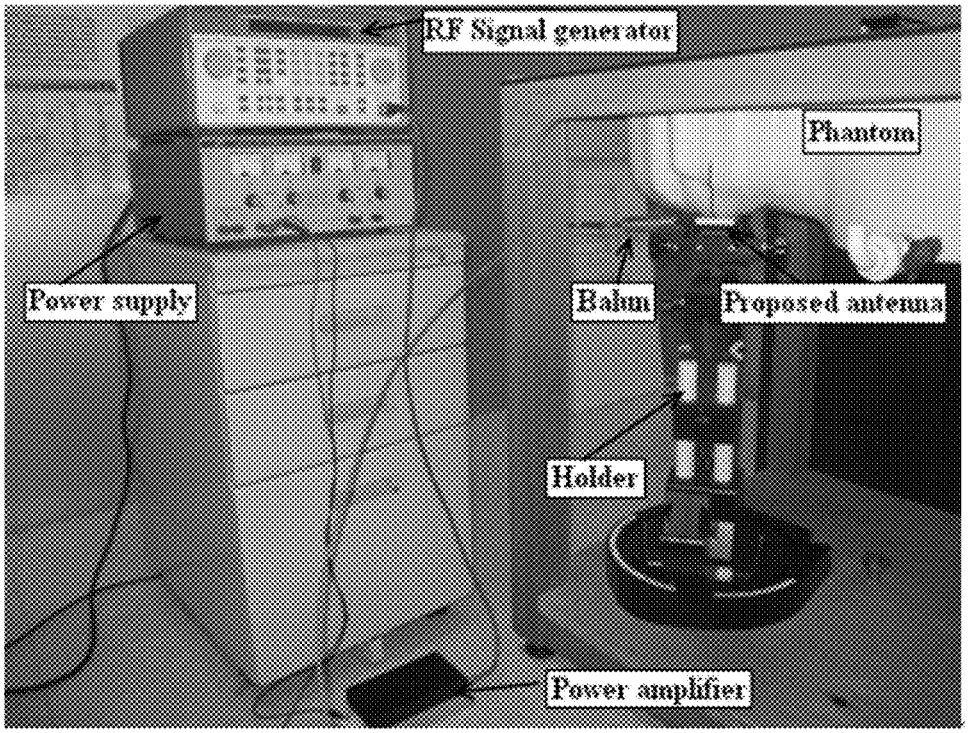
FIG. 16 is a photo of the experimental arrangement for SAR measurement.

The SAR in passive mode has been measured using Dasy-4 system (refer to "I-Fong Chen, Chia-Mei Peng and Sheng-Chieh Liang, "Single layer printed monopole antenna for dual ISM-band operation", *IEEE Trans. Antennas Propagat.*, Vol. 53, No. 4, pp. 1270-1273, April. 2005"), as shown in FIG. 16. The antenna is placed at the cheek position of the right-hand side of the phantom, and the spacing between the ground-plane and the cheek is 3 mm.

Figure 17:
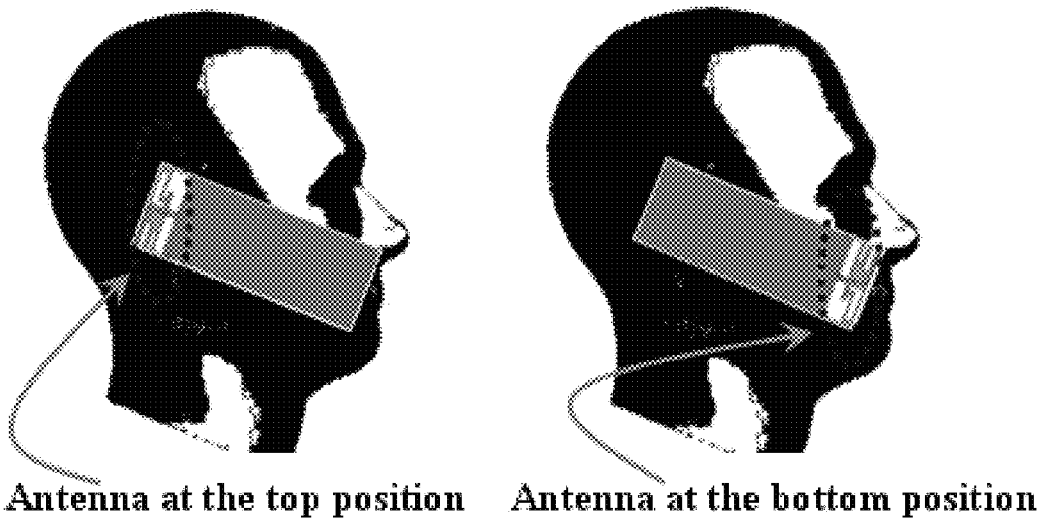
FIG. 17 illustrates the physical model for measuring SAR with the quasi-balanced antenna at the top and bottom positions of the handset body.

Two cases for the proposed quasi-balanced antenna test are shown in FIG. 17. The input power of the proposed quasi-balanced antenna at GSM, CDMA and WCDMA bands is 24 dBm.

However, the input power at DCS and PCS bands is 21 dBm (both considering a user channel being ⅛ of a time slot) (refer to "Chih-Hua Chang and Kin-Lu Wong: 'Printed λ/8-PIFA for Penta-Band WWAN Operation in the Mobile Phone', *IEEE Antennas Propag.*, vol. 57, pp. 1373-1381, May, 2009"). The liquid parameters used in the measurements are listed in Table IV.

TABLE IV

The liquid property of phantom.

| Target frequency | Head | |
|---|---|---|
| (MHz) | εr | σ(S/m) |
| 835 | 41.5 | 0.90 |
| 900 | 41.5 | 0.97 |

TABLE IV-continued

The liquid property of phantom.

| Target frequency | Head | |
|---|---|---|
| (MHz) | εr | σ(S/m) |
| 915 | 41.5 | 0.98 |
| 1800-2000 | 40 | 1.4 |

εr = relative permittivity and σ = conductivity

The measured SAR results in 1-g of simulated tissue from exposure to the antenna radiation are listed in Table V.

TABLE V

The measured SAR results in 1-g of the simulated tissue from exposure to the antenna radiation with two cases of the proposed quasi-balanced antenna to locate at the top and bottom positions of the handset body.

| Frequency (MHz) | Antenna at top position $SAR_{1\,g}$ (m W/g) | Antenna at bottom position $SAR_{1\,g}$ (m W/g) | SAR difference value $SAR_{1\,g}$ (m W/g) |
|---|---|---|---|
| 850 | 1.54 | 0.62 | 0.92 |
| 902 | 1.57 | 0.81 | 0.76 |
| 1720 | 1.32 | 0.28 | 1.04 |
| 1920 | 1.48 | 0.39 | 1.09 |
| 2045 | 1.37 | 0.33 | 1.04 |

When the proposed quasi-balanced antenna is to be located at the top position (normal using mode), it is seen that the 1-g SAR results at all frequencies meet the SAR limit of 1.6 mW/g. We can also observe that the difference between the measured SAR at the top and bottom positions is large. Obviously, this is due to the radiation comes from the antenna rather than the ground-plane. Hence, the handset body (ground-plane) of the proposed quasi-balanced antenna structure cannot be included as a main part of the radiator, since it will lead to low SAR values (refer to "A. Cabedo, J. Anguera, C. Picher, M. Ribó, C. Puente, "Multi-Band Handset Antenna Combining a PIFA, Slots, and Ground Plane Modes", *IEEE Transactions on Antennas and Propagation*, vol. 57, no. 9, pp. 2526-2533, September, 2009").

The measured SAR data of both the proposed quasi-balanced antenna and the conventional PIFA are also presented, as shown in Table VI.

TABLE VI

The measured SAR data of proposed quasi-balanced antenna and the conventional PIFA.

| Frequency (MHz) | Proposed antenna at top position $SAR_{1\,g}$ (m W/g) | PIFA at top position $SAR_{1\,g}$ (m W/g) |
|---|---|---|
| 850 | 1.54 | 1.87 |
| 902 | 1.57 | 1.73 |
| 1720 | 1.32 | 1.53 |
| 1920 | 1.48 | 1.60 |
| 2045 | 1.37 | 1.92 |

The capability of the proposed quasi-balanced antenna is evidenced by mitigating the degradation of the antenna radiated efficiency and reducing the SAR value. In general, the SAR passive test is only a preliminary measurement and the test results are used to analyze the antenna. In practical application, SAR is finally tested with an active device which may result in a different SAR value due to extra device elements.

Figure 18:
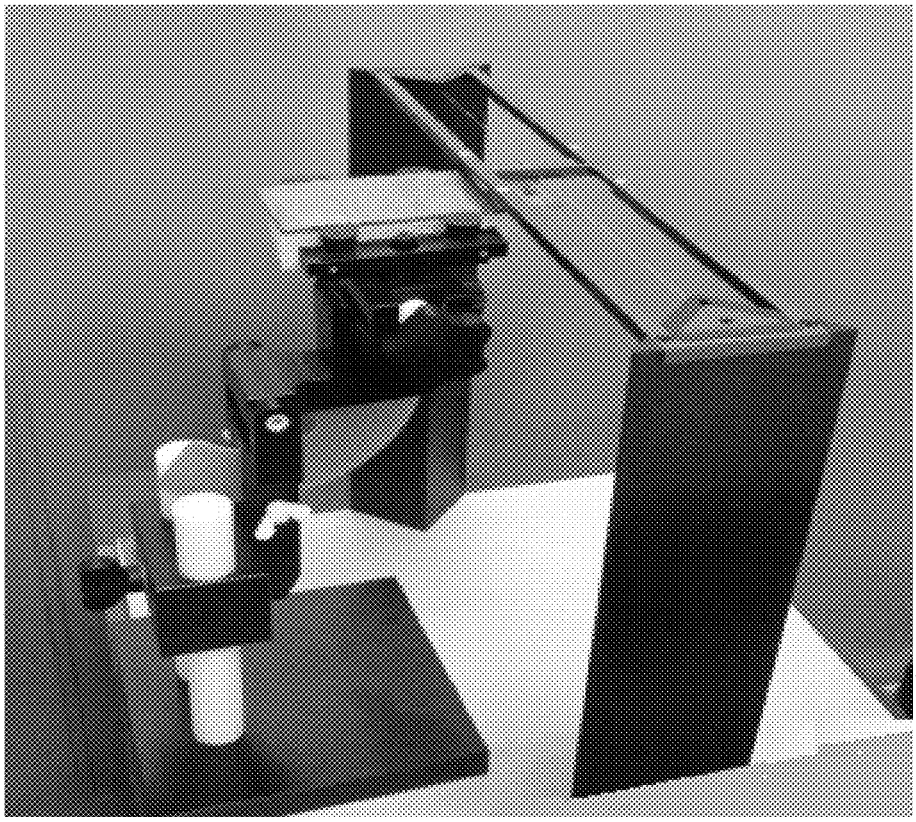
FIG. 18 is a HAC measurement scheme for the proposed antenna.

The HAC study is based on the standard ANSI C63.19-2006, the scheme of measurement is shown in FIG. 18, the near-field distribution at the operating frequencies are evaluated at 50 mm by 50 mm reference plane centered 10 mm above the center of loud-speaker in the mobile phone, the reference plane is divided into nine equal cells, the E-field and H-field strengths are determined by excluding three consecutive cells along the boundary of the reference plane that have the strongest field strength.

Figure 19:
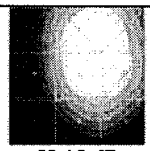
FIG. 19 illustrates the measured near-field strength and category.
Figure 19:
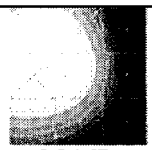
Figure 19:
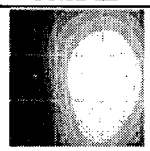
Figure 19:
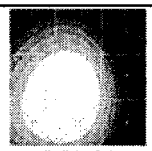
Figure 19:
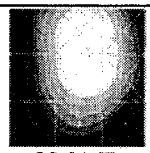
Figure 19:
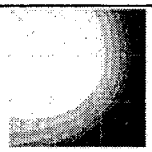
Figure 19:
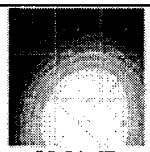
Figure 19:
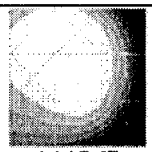
Figure 19:
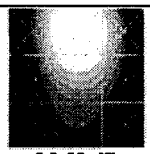
Figure 19:
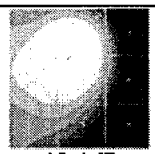

The HAC study is also in passive modes, the input power is 33 dBm at 902 MHz, 30 dBm at 1720 and 1920 MHz, 24 dBm at 850 MHz and 2045 MHz. The measured near-field strengths and category of the HAC model are listed in FIG. 19. From the results, a mobile handset with the proposed antenna falls into M3 and M4 category for all five operating frequencies. These results are also due to the proposed antenna with a quasi-balanced fed structure.

In conclusion, in this specification, the proposed quasi-balanced hexa-band antenna is practically capable to operate at the CDMA, GSM, DCS, PCS, WCDMA and Bluetooth bands. We demonstrated that a printed asymmetric T-type monopole with a solid shorting-line and a solid open-stub structure provides the hexa-band operation. By correctly choosing the shorting-line parameters and by modifying the shape of the T-type monopole arms, two bandwidths, 15% and 37.6%, can be obtained. In addition, the proposed antenna structure is similar to the modified Type III balun and dipole fed by microstrip-line, as a consequence, a "quasi-balanced" antenna structure is formed. This quasi-balanced antenna structure is compared with the unbalanced antenna structure (conventional PIFA), results show that the former has the smaller power loss (dB absorption) due to the influence of phantom-head model and the lower SAR and HAC values. The contribution of this specification is to implement a simple and low profile antenna for the practical mobile handset application. Measurement results show that a broad bandwidth is obtained. Although this antenna is designed for mobile handset applications, this design concept can be extended to the antenna design for laptop computers.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. A quasi-balanced fed antenna structure, comprising:

a substrate having a first edge and a second edge located on opposing sides of the substrate;

an asymmetric T-type monopole element printed on said substrate, said asymmetric T-type monopole element comprising a solid shorting-line extending across a top of thereof, a first asymmetric radiation strip extending along the first edge of the substrate and connected to said solid shorting-line and forming a balanced antenna, a solid open-stub, and a second asymmetric radiation strip extending along the second edge of the substrate and connected to said solid open-stub and forming an unbalanced antenna;

a feeding-point located on a bottom of said asymmetric T-type monopole element; and a shorting-point located on the bottom of said asymmetric T-type monopole element and electrically connected to said solid shorting-line.

2. The quasi-balanced fed antenna structure as claim 1, wherein said first asymmetric radiation strip is a loop antenna.

3. The quasi-balanced fed antenna structure as claim 1, wherein said first asymmetric radiation strip comprises a plurality of slits.

4. The quasi-balanced fed antenna structure as claim 1, wherein said substrate is a glass epoxy substrate having a metal ground-plane on a backside thereof.

5. The quasi-balanced fed antenna structure as claim 3, wherein said plurality of slits of said first asymmetric radiation strip have a rectangular shape.

* * * * *